US006336339B1

(12) United States Patent
Joung et al.

(10) Patent No.: US 6,336,339 B1
(45) Date of Patent: Jan. 8, 2002

(54) DAMPER FOR REFRIGERATORS

(75) Inventors: Il-Uk Joung; Do-Hyung Kim, both of Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/588,649

(22) Filed: Jun. 7, 2000

(30) Foreign Application Priority Data

Jun. 9, 1999 (KR) ..... 99-21390
Sep. 11, 1999 (KR) ..... 99-38869

(51) Int. Cl.[7] ..... F25D 19/00

(52) U.S. Cl. ..... 62/285; 62/408; 62/186; 62/187

(58) Field of Search ..... 62/285, 408, 186, 62/187

(56) References Cited

U.S. PATENT DOCUMENTS 5,172,566 A * 12/1992 Jung et al. ..... 62/186
5,191,774 A * 3/1993 Park ..... 62/408
5,398,599 A * 3/1995 Woo ..... 99/468
5,460,010 A * 10/1995 Kobayashi et al. ..... 62/187
5,802,867 A * 9/1998 Kang ..... 62/408
5,876,014 A * 2/1999 Noritake et al. ..... 251/129.12
5,983,654 A * 11/1999 Yamamoto et al. ..... 62/187
6,073,458 A * 6/2000 Kim ..... 62/186

* cited by examiner

*Primary Examiner*—William Doerrler
*Assistant Examiner*—Mark Shulman
(74) *Attorney, Agent, or Firm*—Fleshner & Kim, LLP

(57) ABSTRACT

A damper for refrigerators is disclosed. The damper of this invention effectively vaporizes moisture drops, condensed on a higher temperature surface of a damper's baffle due to a dewing phenomenon caused by a difference in temperature between opposite surfaces of the baffle, thus allowing the baffle to be almost free from freezing. In order to expose the moisture drops on the higher temperature surface of the baffle to cool air flowing through the cool air passage for the fresh compartment when the baffle is opened, the baffle is rotatably held by a rotating shaft installed on the central portion of the baffle or by a hinge pin spaced apart from the baffle by a distance. In the damper of this invention, the moisture drops, condensed on the higher temperature surface of the baffle due to a temperature difference between opposite surfaces of the baffle while the baffle is closed, are fully exposed to the dry cool air when the baffle is opened, and so it is possible for the moisture drops to be quickly evaporated and absorbed by the cool air. The damper of this invention thus effectively prevents its baffle from freezing due to the condensed moisture drops and allows the baffle to be smoothly operated without failure, and improves the operational reliability and market competitiveness of the refrigerators.

22 Claims, 4 Drawing Sheets

DAMPER FOR REFRIGERATORS

BACKGROUND OF THE INVENTION

1. Field of the Invention

The present invention relates, in general, to a damper for refrigerators and, more particularly, to a structural improvement in such a damper to effectively vaporize moisture drops, condensed on a higher temperature surface of a damper's baffle due to a dewing phenomenon caused by a difference in temperature between opposite surfaces of the baffle, thus allowing the baffle to be almost free from freezing on the surface.

2. Description of the Prior Art

As well known to those skilled in the art, refrigerators are machines which are designed to supply cool air, formed through heat exchanging processes of evaporators, into freezing and fresh compartments, thus keeping food within the two compartments while freezing the food within the freezing compartment and maintaining the freshness of food within the fresh compartment for an expected period of time. In conventional refrigerators, the supply of cool air for the freezing and fresh compartments is automatically controlled in order to accomplish preset desired temperatures within the compartments. In order to accomplish such a cool air supply control during an operation of a refrigerator, a damper is installed within the refrigerator. That is, the supply of cool air for the freezing and fresh compartments in conventional refrigerators is automatically and repeatedly stopped and restarted under the control of a damper.

In conventional refrigerators, the damper is installed on the cool air passage for the fresh compartment. FIGS. 1 and 2 show the construction of a conventional damper used for controlling the supply of cool air for the fresh compartment in a refrigerator.

As shown in FIGS. 1 and 2, the damper 10 is installed on the cool air passage for the fresh compartment of the refrigerator and controls the cool air supply for the fresh compartment. The arrow in FIG. 2 designates the flow direction of cool air from an evaporator into the fresh compartment through the damper 10. That is, the cool air, formed through a heat exchanging process performed by the evaporator installed within a heat exchanger chamber defined at the rear of the fresh compartment, is supplied into the fresh compartment under the control of the damper 10.

The damper 10 of FIGS. 1 and 2 is disclosed in U.S. Pat. No. 5,876,014. In a detailed description, the above damper 10 comprises a frame 12 having a cool air passing hole 12*a*, with a baffle 14 being hinged to the frame 12 and controlling the cool air passing hole 12*a*. The above baffle 14 is rotatable relative to the frame 12 by the rotating force of a stepping motor 20 in opposite directions, thus selectively opening or closing the cool air passing hole 12*a*.

In order to transmit the rotating force of the stepping motor 20 to the baffle 14, a gear transmission mechanism is provided in the damper 10 as follows. That is, a pinion gear 22 is fixed to the rotating shaft 20*a* of the stepping motor 20 and transmits the rotating force of the motor 20 to a sectoral gear 24. The above sectoral gear 24 is fixed to the rotating shaft P of the baffle 14, and so the rotating shaft P is rotatable in cooperation with a rotating action of the sectoral gear 24. The stepping motor 20 and the gear transmission mechanism constitutes a drive unit for the baffle 14. When the rotating shaft P is rotated by the rotating action of the sectoral gear 24, the baffle 14 is rotated from its closed position shown by the solid line in FIG. 2 to its open position shown by the phantom line in the drawing, thus opening the cool air passing hole 12*a*.

However, such a conventional damper 10 is problematic as follows. That is, when the baffle 14 is kept in its closed position as shown by the solid line in FIG. 2, there is an undesirable difference in temperature between opposite surfaces of the baffle 14. The left-hand surface of the baffle 14 in the drawing directly faces the cool air discharged from the evaporator, and so said surface is lower in temperature than the right-hand surface of the baffle 14 facing the fresh compartment. That is, the right-hand surface of the baffle 14 is higher in temperature than the left-hand surface due to the temperature within the fresh compartment and is dampened due to moisture escaping from food kept in the fresh compartment.

Due to such a difference in temperature between opposite surfaces of the baffle 14, moisture is condensed and forms small drops on the right-hand surface of the baffle 14 facing the fresh compartment. Such small drops of moisture condensed on the surface of the baffle 14 are undesirably frozen particularly at the edge of the baffle 14 due to the cool air flowing on the baffle 14. The rotating shaft P of the baffle 14 in the conventional damper 10 may be thus easily frozen, and may fail to smoothly rotate the baffle 14.

Such a problem, experienced in the conventional damper, ill-affects the operational function of the damper and finally deteriorates the operational reliability of refrigerators. This reduces the market competitiveness of the refrigerators.

SUMMARY OF THE INVENTION

Accordingly, the present invention has been made keeping in mind the above problems occurring in the prior art, and an object of the present invention is to provide a damper for refrigerators, which is designed to allow the baffle, installed around a cool air passage for the fresh compartment of a refrigerator, to be free from freezing.

Another object of the present invention is to provide a damper for refrigerators, which gives an appropriate quantity of moisture to the cool air for the fresh compartment of a refrigerator, thus allowing food in the fresh compartment to maintain its moisture and freshness for a desired period of time.

In order to accomplish the above object, the primary embodiment of the present invention provides a damper for refrigerators, comprising: a frame installed in the cool air passage within a refrigerator and having a cool air passing hole; a baffle selectively opening or closing the air passing hole of the frame; a rotating shaft rotatably holding the baffle relative to the frame while being installed on the baffle at a position between upper and lower edges of the baffle; and a drive unit rotating the baffle relative to the frame.

In the above damper, the baffle is rotatable around the rotating shaft so as to selectively open or close the cool air passing hole of the frame while exposing moisture drops condensed on a surface thereof to cool air flowing through the cool air passage when the baffle is rotated to open the cooling air passing hole.

In addition, the drive unit comprises: a drive power source generating a rotating force for the baffle; and a gear transmission mechanism transmitting the rotating force of the drive power source to the baffle.

The second embodiment of this invention provides a damper for refrigerators, comprising: a frame installed in a cool air passage within a refrigerator and having a cool air passing hole; a baffle selectively opening or closing the air passing hole of the frame; a link extending from an edge of the baffle while forming an angle between the link and the baffle, thus holding the baffle, the link having a hinge pin at an outside end thereof; and a drive unit rotating the baffle relative to the frame.

In the above damper, the baffle is rotatable around the hinge pin so as to selectively open or close the cool air passing hole of the frame while exposing moisture drops condensed on a surface thereof to cool air flowing through the cool air passage when the baffle is rotated to open the cooling air passing hole.

On the other hand, the angle between the baffle and the link ranges from 90° to 135°.

In the above damper, the drive unit comprises: a drive power source generating a rotating force for the baffle; and a gear transmission mechanism transmitting the rotating force of the drive power source to the baffle.

In the damper of this invention, the moisture drops, condensed on the higher temperature surface of the baffle due to a temperature difference between opposite surfaces of the baffle while the baffle is closed, are fully exposed to the dry cool air when the baffle is opened. It is thus possible for the moisture drops to be quickly evaporated and absorbed by the dry cool air. The damper thus effectively prevents the baffle from freezing due to the condensed moisture drops and allows the baffle to be smoothly operated without failure. This finally improves the operational reliability of the damper and refrigerators.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
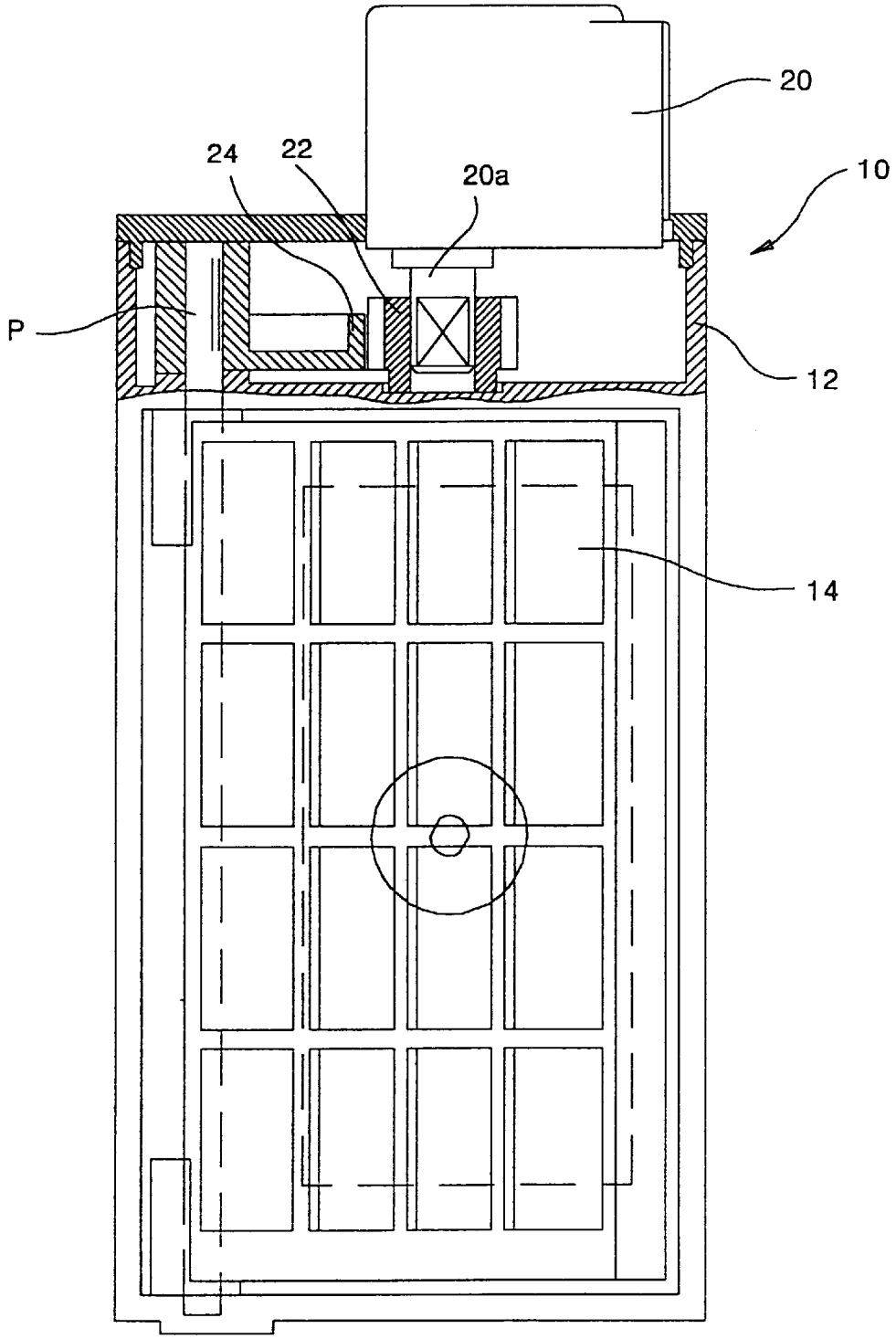
FIG. 1 is a front view of a conventional damper for refrigerators.
Figure 2:
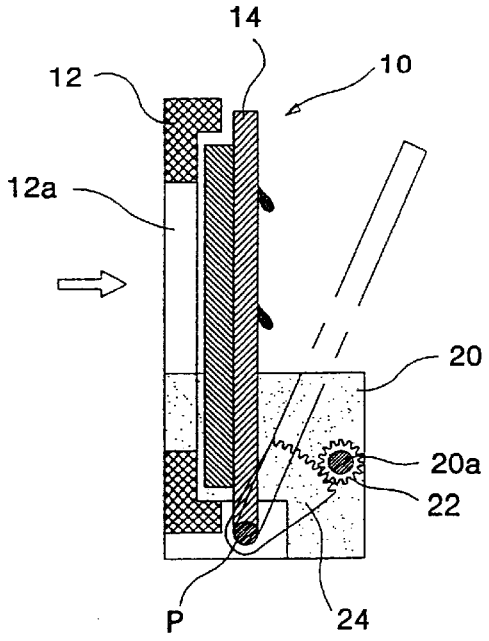
FIG. 2 is a sectional view showing the operation of the conventional damper of FIG. 1.
Figure 3:
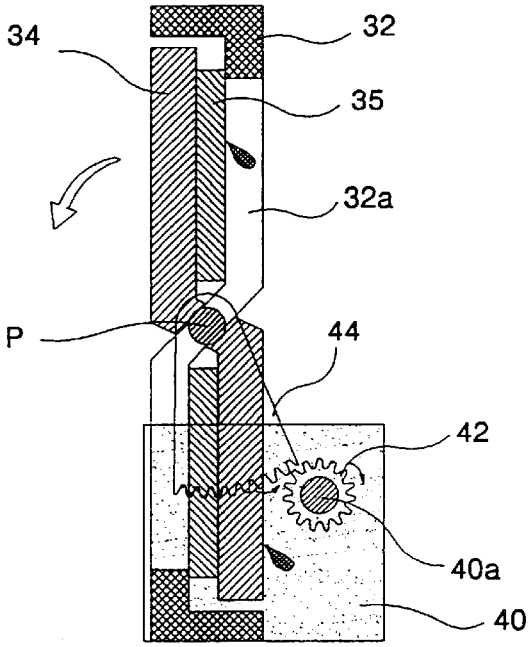
FIG. 3 is a sectional view, showing a baffle included in the damper for refrigerators in accordance with the primary embodiment of this invention when the baffle closes the cool air passage for the fresh compartment of a refrigerator.

FIG. 3 shows a damper for refrigerators in accordance with the primary embodiment of this invention. As shown in the drawing, the damper according to the primary embodiment of this invention comprises a frame 32 having a cool air passing hole 32*a*, with a baffle 34 being hinged to the frame 32 and controlling the cool air passing hole 32*a*.

In the same manner as that described for the conventional damper, the frame 32 is installed on the cool air passage for the fresh compartment and allows cool air to be supplied from an evaporator into the fresh compartment through the cool air passing hole 32*a* of the frame 32. Since the baffle 34 controls the cool air passing hole 32*a* of the frame 32, the baffle 34 controls the supply of cool air for the fresh compartment.

The above baffle 34 is hinged to the frame 32 by a rotating shaft P provided at the central portion of the baffle 34. That is, the baffle 34 is rotatable along with the rotating shaft P relative to the frame 32 in opposite directions, thus selectively opening or closing the cool air passing hole 32*a*. In the present invention, the above rotating shaft P may be cast with the baffle 34 into a single structure. Alternatively, the rotating shaft P may be produced separately from the baffle 34 prior to being fixed to the baffle 34.

The rotating shaft P is rotatable by the rotating force of stepping motor 40. In order to transmit the rotating force of the stepping motor 40 to the rotating shaft P, a gear transmission mechanism is provided in the damper of this invention as follows. That is, a sectoral gear 44 is fixed to the rotating shaft P of the baffle 34, thus being rotatable along with the baffle 34. The above sectoral gear 44 is provided with teeth on its arcuate edge and engages with the teeth of a pinion gear 42. The above pinion gear 42 is fixed to the rotating shaft 40*a* of the stepping motor 40 installed at a side of the damper. The stepping motor 40 and the gear transmission mechanism constitutes a drive unit for the baffle 34.

The rotating force of the stepping motor 40 is transmitted to the rotating shaft P and rotates the shaft P along with the baffle 34 as follows. When the stepping motor 40 is turned on, the rotating shaft 40*a* of the motor 40 is rotated along with the pinion gear 42. The rotating force of the pinion gear 42 is transmitted to the sectoral gear 44, thus rotating the sectoral gear 44. Therefore, the rotating shaft P along with the baffle 34 is rotated in response to such a rotating action of the sectoral gear 44. The toothed circumference of the arcuate edge of the sectoral gear 44 determines the rotating angle of the baffle 34, and so it is necessary to set the toothed circumference of the sectoral gear 44 in accordance with a desired rotating angle of the baffle 34.

The operational effect of the damper according to the primary embodiment of this invention will be described hereinbelow in conjunction with FIGS. 3 and 4.

When the baffle 34 is in its closed position as shown in FIG. 3, there is a temperature difference between opposite surfaces of the baffle 34. That is, the left-hand surface of the baffle 34, directly facing the cool air discharged from the evaporator, is lower in temperature than the right-hand surface of the baffle 34 facing the fresh compartment. Due to such a difference in temperature between opposite surfaces of the baffle 34, moisture is condensed and forms small drops on the right-hand surface of the baffle 34. Even though an insulation material 35 is provided at the junction between the baffle 34 and the cool air passing hole 32*a* of the frame 32, it is almost impossible for the insulation material 35 to prevent a formation of such small drops on the right-hand surface of the baffle 34 by a condensation of moisture on said surface due to a temperature difference between the two surfaces.

The baffle 34 is opened when it is desired to supply cool air into the fresh compartment. In order to open the baffle 34, the pinion gear 42 is rotated clockwise around the rotating shaft P in FIG. 3 by the rotating force of the stepping motor 40, thus allowing the sectoral gear 44 to be rotated counterclockwise. The rotating shaft P along with the baffle 34 is rotated counterclockwise, thus opening the cool air passing hole 32*a* of the frame 32 as shown in FIG. 4.

When the baffle 34 opens the cool air passing hole 32*a* as described above, cool air is supplied from the evaporator into the fresh compartment through the open hole 32*a*. In such a case, the cool air for the fresh compartment flows through two passages A and B divided by the open baffle 34. That is, the baffle 34 in its open position is horizontally positioned within the cool air passage for the fresh compartment in a way such that the surface of the baffle 34, coated with the condensed moisture drops, is fully exposed to cool air flowing through the passage A.

The cool air, flowing through the passage A, is dry air having a low temperature, and so the moisture drops on the surface of the baffle 34 are quickly evaporated by the cool air prior to being absorbed by the cool air.

The construction of the damper of this invention may be altered as follows.

Figure 5:
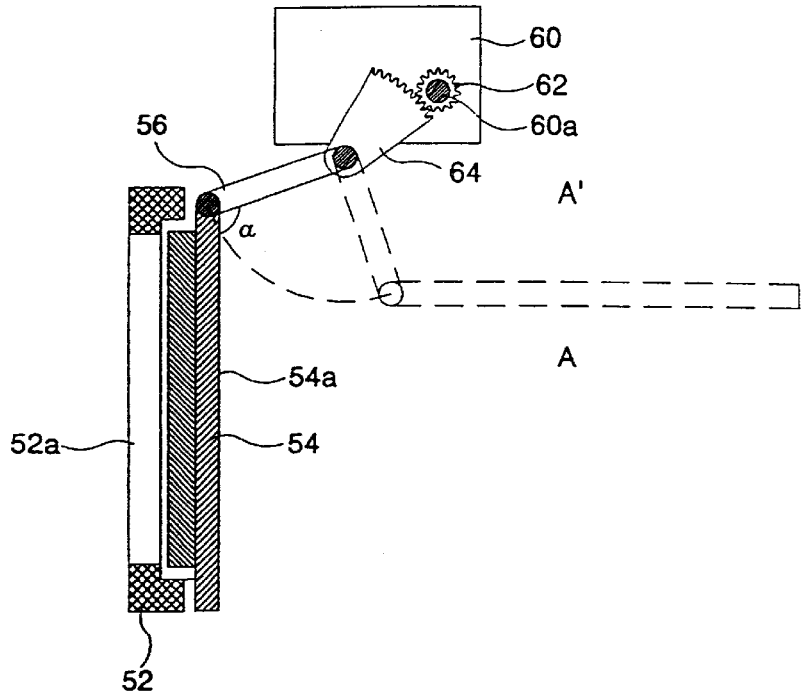
FIG. 5 is a sectional view of a damper for refrigerators in accordance with the second embodiment of the present invention.

FIG. 5 shows a damper for refrigerators in accordance with the second embodiment of this invention. As shown in the drawing, the damper according to the second embodiment is designed to allow the baffle 54 to be rotatable around a hinged shaft, spaced from the baffle body by a distance, so as to control the cool air passing hole 53*a* of the frame 52. In this embodiment, when the baffle 54 is opened, the surface of the baffle 54, coated with moisture drops condensed on the surface due to a temperature difference between opposite surfaces of the baffle 54, is thus fully exposed to cool air discharged from the evaporator into the fresh compartment.

In order to accomplish the above structure of the damper according to the second embodiment, two links 56 are fixed to opposite upper corners of the baffle 54 at positions around the top edge of the right-hand surface 54*a* of the baffle 54, with an angle α being formed between the right-hand surface 54*a* and each of the links 56. A rotating pin 56*a* is provided at the outside ends of the two links 56 and acts as a rotating axis of the baffle 54. A sectoral gear 64 is fixed to the rotating pin 56*a* and engages with a pinion gear 62 integrated with the rotating shaft 60*a* of a stepping motor 60. The rotating pin 56*a* along with the baffle 54 is thus rotatable in opposite directions by the rotating force of the stepping motor 60 transmitted to the shaft 56*a* through the pinion 62 and the sectoral gear 64, thus selectively opening or closing the cool air passing hole 52*a* of the frame 52. The damper according to the second embodiment is characterized in that the rotating axis of the baffle 54 is not positioned on the baffle body, but is positioned at a position spaced apart from the baffle body by a predetermined distance different from the primary embodiment of this invention.

When the stepping motor 60 is started, the baffle 54 is rotated around the rotating pin 56*a* counterclockwise, thus reaching its open position as shown by the phantom line of FIG. 5 and opening the cool air passing hole 52*a* of the frame 52. In such a case, the junction points between the baffle 54 and the links 56 are moved downward when the baffle 54 is rotated counterclockwise from its closed position to its open position, thus allowing the surface 54*a* of the baffle 54 coated with the condensed moisture drops to be fully exposed to the cool air flowing in the linear cool air passage formed by the open hole 52*a* of the frame 52. It is thus possible to evaporate the moisture drops on the surface 54*a* using the dry cool air.

The links 56, included in the damper of the second embodiment, are very important elements and will be described in more detail hereinbelow.

Figure 6:
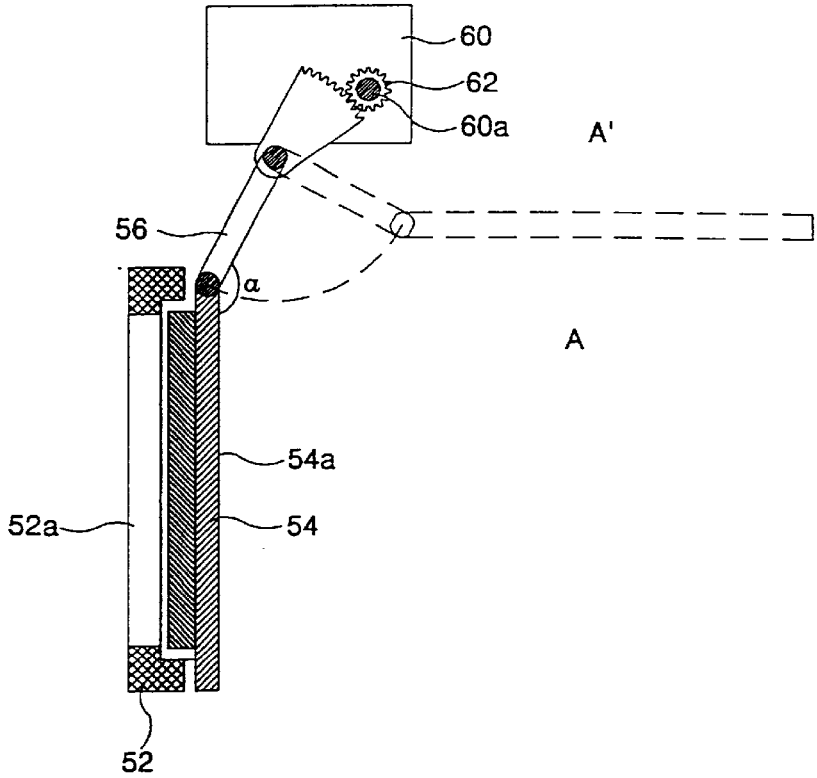
FIG. 6 is a sectional view, showing a post-rotating position of a baffle included in the damper according to the second embodiment of this invention when the angle between the baffle and links of the damper is undesirably set to be larger than 135°.

In the damper according to the second embodiment, it is necessary to appropriately set the angle α between the baffle body and the links 56. That is, when the angle a is set to be less than 90°, the baffle 54 is undesirably interfered with the frame 52 during a rotating action of the baffle 54. On the other hand, when the angle α is set to be larger than 135°, the baffle 54 in its fully open position is undesirably positioned outside the linear cool air passage as shown in FIG. 6, and fails to accomplish the object of this invention. That is, when the angle a is set to be larger than 135°, the post-rotating position of the junction points between the baffle body and the links 56 is undesirably moved upward from the pre-rotating position of said junction points, thereby undesirably allowing the baffle 54 to be positioned outside the linear cool air passage for the fresh compartment. Therefore, it is necessary to set the angle α between the baffle 54 and the links 56 in the second embodiment of this invention to a range of 90°~135°.

The length of each link 56 is determined as follows. The length of each link 56 determines the amount of cool air flowing over the surface 54*a* of the baffle 54. When each of the links 56 is lengthened, it is possible to position the baffle 54 at a lower position close to the central axis of the cool air passage when the baffle 54 is fully opened. In such a case, the moisture drops condensed on the surface 54*a* of the baffle are more quickly evaporated. However, it should be understood that it is necessary to appropriately determine the length of each link 56 while considering the fact that such an increase in length of each link 56 also results in both an increase in moment around the rotating pin 56*a* and a limitation while designing and installing the damper.

The operational effect of the damper according to the second embodiment of this invention will be described hereinbelow in conjunction with FIG. 5. In the same manner as that described for the damper according to the primary embodiment, the baffle 54 of the second embodiment in its closed position is inevitably coated with moisture drops condensed on its surface 54*a* due to a temperature difference between its opposite surfaces.

The baffle 54 is opened when it is desired to supply cool air into the fresh compartment. In order to open the baffle 54, the pinion gear 62 is rotated by the rotating force of the stepping motor 60, thus allowing the sectoral gear 64 to be rotated. The links 56 along with the baffle 54 are thus rotated to open the cool air passing hole 52*a* of the frame 52. Therefore, the baffle 54 is horizontally positioned within the linear cool air passage for the fresh compartment as shown by the phantom line in FIG. 5. The cool air from the cool air passing hole 52*a* of the frame 52 flows through two passages A' and B' divided by the horizontally positioned baffle 54. The moisture drops formed on the surface 54*a* of the baffle 54 are exposed to the dry cool air flowing through the passage A', thus being quickly evaporated and absorbed by the cool air.

As described above, the damper of this invention is designed to expose the moisture drops, condensed on one surface of a baffle 34 or 54, to dry cool air discharged from the evaporator into the fresh compartment when the baffle is opened. In order to accomplish the above operational effect of the damper, the baffle 34 or 54 is rotatably held by a rotating shaft or a hinge pin positioned at the center of the baffle body or at a rotating axis spaced apart from the baffle body by a distance.

Figure 4:
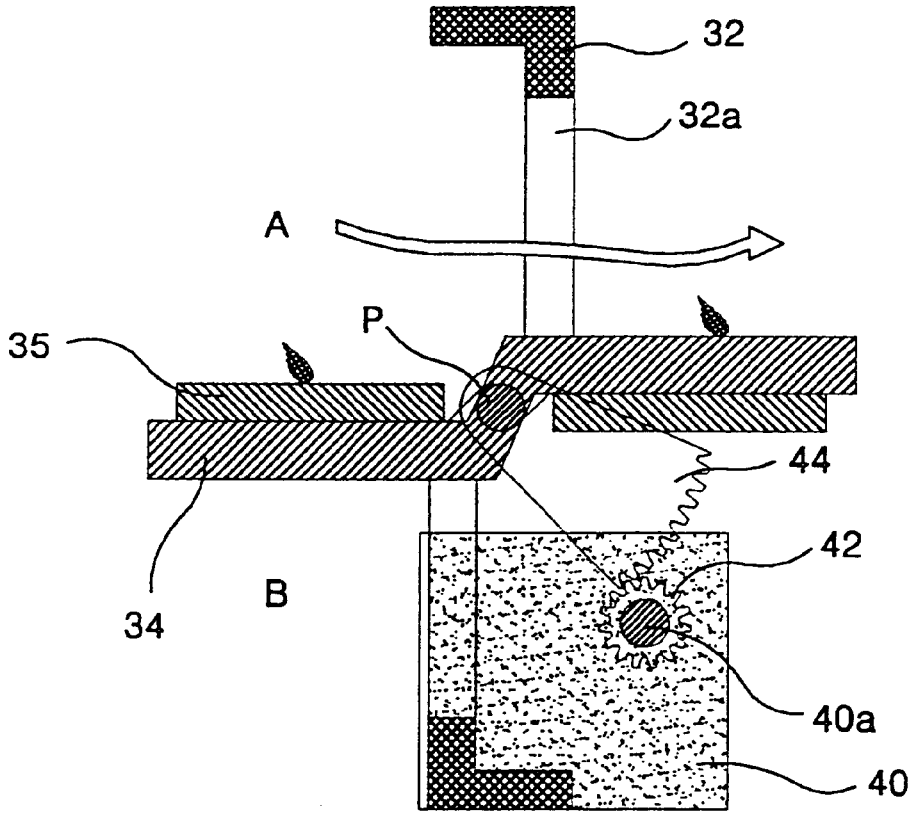
FIG. 4 is a sectional view, showing the baffle FIG. 3 when the baffle opens the cool air passage for the fresh compartment.

Of course, it should be understood that the construction of the baffle included in the damper of this invention may be changed from the above-mentioned construction shown in FIGS. 3 to 5 if such a change does not affect the functioning of this invention.

That is, the preferred embodiments use a stepping motor 40 or 60 as a source of the rotating force for the baffle 34 or 54. However, such a rotating force may be generated by another conventional device in place of the stepping motors 40 and 60 if the device gives a desired rotating force to the baffle 34 or 54 so as to rotate the baffle around a rotating shaft and to control the cool air passage for the fresh compartment.

In the preferred embodiments, the rotating force of the stepping motor 40 or 60 is transmitted to the rotating shaft P or the hinge pin 56*a* through the sectoral gear 44 or 64. However, it should be understood that such a power transmission from the stepping motor to the rotating shaft or the hinge pin in the damper of this invention may be accomplished by another gear in place of such a sectoral gear. That is, the shape of the transmission gear used for transmitting the rotating force of the stepping motor to the rotating shaft or the hinge pin is not limited to such a sectoral shape.

In the dampers according to the preferred embodiments of this invention, the baffle 34 or 54 is integrated with the rotating shaft P or the hinge pin 56*a* so as to be rotatable along with the rotating shaft P or the hinge pin 56*a* by the rotating force from a stepping motor. However, it should be understood that the shaft P or 56*a* may be designed to form a fixed rotating axis for the baffle 34 or 54, with the baffle being designed to be rotatable around the fixed rotating axis by the rotating force of a stepping motor.

As described above, the present invention provides a damper for refrigerators. This damper is designed to effectively vaporize moisture drops, condensed on a higher temperature surface of a damper's baffle due to a difference in temperature between opposite surfaces of the baffle, thus allowing the baffle to be almost free from freezing on the surface. In order to accomplish the above object, the damper of this invention is designed to expose the baffle to dry cool air at a surface of the baffle coated with condensed moisture drops when the baffle is opened. The moisture drops are thus quickly evaporated and absorbed by the dry cool air, and so the damper is almost free from freezing of the surface of the baffle or of the drive unit for the baffle. This finally allows the damper to be reliably operated irrespective of condensation of moisture drops on the baffle and accomplishes a desired operational reliability of refrigerators.

A collateral advantage of the damper according to the invention resides in that the moisture drops on the baffle are evaporated and absorbed by cool air for the fresh compartment. Such cool air desirably moisturizes food kept in the fresh compartment, thus overcoming a conventional problem of drying food in the fresh compartment. The cool air, laden with an appropriate amount of moisture, finally allows desired freshness of food within the fresh compartment to be maintained for an expected period of time.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A damper for refrigerators, comprising:

a frame installed in a cool air passage within a refrigerator and having a cool air passing hole;

a baffle selectively opening or closing said air passing hole of the frame;

a rotating shaft rotatably holding said baffle relative to the frame while being installed on the baffle at a position between upper and lower edges of the baffle; and a drive unit rotating said baffle relative to the frame, wherein said baffle is rotatable around the rotating shaft so as to selectively open or close said cool air passing hole of the frame while exposing moisture drops condensed on a surface thereof to cool air flowing through the cool air passage when the baffle is rotated to open the cooling air passing.

2. The damper according to claim 1, wherein said drive unit comprises:

a drive power source generating a rotating force for the baffle; and a gear transmission mechanism transmitting the rotating force of the drive power source to said baffle.

3. A damper for refrigerators, comprising:

a frame installed in a cool air passage within a refrigerator and having a cool air passing hole;

a baffle selectively opening or closing said air passing hole of the frame;

a link extending from an edge of said baffle while forming an angle between the link and the baffle, thus holding the baffle, said link having a hinge pin at an outside end thereof; and a drive unit rotating said baffle relative to the frame, wherein said baffle is rotatable around the hinge pin so as to selectively open or close said cool air passing hole of the frame while exposing moisture drops condensed on a surface thereof to cool air flowing through the cool air passage when the baffle is rotated to open the cooling air passing hole.

4. The damper according to claim 3, wherein said angle between the baffle and the link ranges from 90° to 135°.

5. The damper according to claim 3, wherein said drive unit comprises:

a drive power source generating a rotating force for the baffle; and a gear transmission mechanism transmitting the rotating force of the drive power source to said baffle.

6. A damper for refrigerators, comprising:

a frame installed in a cool air passage within a refrigerator and having a cool air passing hole;

a baffle selectively opening or closing said cool air passing hole of the frame;

a rotating shaft providing a rotating axis of the baffle, thus allowing the baffle to be rotatable so as to selectively open or close said cool air passing hole of the frame; and a drive unit rotating said baffle relative to the frame, whereby moisture drops, condensed on a surface of said baffle, are exposed to cool air flowing through the cool air passage when the baffle is rotated to open the cooling air passing hole of the frame.

7. The damper according to claim 1, wherein the surface is a surface of the baffle disposed within a refrigeration compartment of a refrigerator when the baffle is closed.

8. The damper according to claim 1, wherein, when the baffle is in an open position, in which position the cool air passing hole of the frame is open creating a flow of cool air therethough, the baffle remains at least partially within a path of the flow.

9. The damper according to claim 8, wherein the rotating shaft is disposed within a substantially central portion of the flow.

10. The damper according to claim 3, wherein the surface is a surface of the baffle disposed within a refrigeration compartment of a refrigerator when the baffle is closed.

11. The damper according to claim 3, wherein, when the baffle is in an open position, in which position the cool air passing hole of the frame is open creating a flow of cool air therethough, the baffle remains at least partially within a path of the flow.

12. The damper according to claim 6, wherein the surface is a surface of the baffle disposed within a refrigeration compartment of a refrigerator.

13. A damper for a refrigerator, comprising:

a frame installed in an air passage within a refrigerator and having an air passing hole disposed therein;

a baffle configured to selectively open or close the air passing hole of the frame;

a rotating shaft configured to rotatably hold the baffle relative to the frame; and a drive unit configured to rotate the baffle relative to the frame, wherein, when the baffle is in an open position, in which position the air passing hole of the frame is open creating a flow of air therethough, the baffle remains at least partially within a path of the flow.

14. The damper according to claim 13, wherein, when the baffle is in an open position, a portion of the baffle is disposed within a refrigerator compartment of the refrigerator, and a portion of the battle is disposed within the air passage.

15. The damper according to claim 13, wherein the rotating shaft is disposed within a substantially central portion of the flow.

16. The damper according to claim 13, wherein the drive unit comprises:

a drive power source configured to generate a rotating force for the baffle; and a gear transmission mechanism configured to transmit the rotating force of the drive power source to the baffle.

17. The damper according to claim 13, wherein the rotating shaft is installed on the baffle at a position between upper and lower edges of the baffle.

18. The damper according to claim 17, wherein the rotating shaft is installed on the baffle at a substantially center position between upper and lower edges of the baffle.

19. A damper for a refrigerator, comprising:

a frame installed in an air passage within a refrigerator and having an air passing hole disposed therein;

a baffle configured to selectively open or close the air passing hole of the frame;

a link extending from an edge of the baffle and forming an angle with the baffle, wherein the link holds the baffle with respect to the frame; and a drive unit configured to rotate the baffle relative to the frame, wherein, when the baffle is in an open position, in which position the air passing hole of the frame is open creating a flow of air therethough, the baffle remains at least partially within a path of the flow.

20. The damper according to claim 19, wherein the link includes a hinge pin at an outside edge thereof, and wherein the baffle is rotatable about the hinge pin so as to selectively open or close the air passing hole of the frame.

21. The damper according to claim 19, wherein the angle formed between the baffle and the link ranges from 90° to 135°.

22. The damper according to claim 19, wherein the drive unit comprises:

a drive power source configured to generate a rotating force for the baffle; and a gear transmission mechanism configured to transmit the rotating force of the drive power source to the baffle.

* * * * *